US005418108A

United States Patent [19]

Kmiecik-Lawrynowicz et al.

[11] Patent Number: 5,418,108

[45] Date of Patent: * May 23, 1995

[54] TONER EMULSION AGGREGATION PROCESS

[75] Inventors: Grazyna E. Kmiecik-Lawrynowicz, Burlington; Raj D. Patel, Oakville, both of Canada

[73] Assignee: Xerox Corporation, Stamford, Conn.

[ * ] Notice: The portion of the term of this patent subsequent to Sep. 13, 2011 has been disclaimed.

[21] Appl. No.: 82,741

[22] Filed: Jun. 25, 1993

[51] Int. Cl.[6] ..... G03G 9/08

[52] U.S. Cl. ..... 430/137; 430/109; 523/335; 528/936

[58] Field of Search ..... 430/137, 109; 528/936; 523/335

[56] References Cited

U.S. PATENT DOCUMENTS

| | | | |
|---|---|---|---|
| 4,052,353 | 10/1977 | Scanley | 523/335 |
| 4,137,188 | 1/1979 | Uetake et al. | 252/62.1 P |
| 4,299,952 | 11/1981 | Pingel et al. | 528/936 |
| 4,487,857 | 12/1984 | Sugimori et al. | 523/335 |
| 4,558,108 | 12/1985 | Alexandru et al. | 526/340 |
| 4,668,738 | 5/1987 | Lee et al. | 523/335 |
| 4,797,339 | 1/1989 | Maruyama et al. | 430/109 |
| 4,831,116 | 5/1989 | Henton | 528/936 |
| 4,983,488 | 1/1991 | Tan et al. | 430/137 |
| 4,996,127 | 2/1991 | Hasegawa et al. | 430/109 |
| 5,064,938 | 11/1991 | Suzuki et al. | 523/335 |
| 5,262,269 | 11/1993 | Nair et al. | 430/137 |
| 5,346,797 | 9/1994 | Kmiecik-Lawrynowicz et al. | 430/137 |

*Primary Examiner*—Christopher D. Rodee
*Attorney, Agent, or Firm*—E. O. Palazzo

[57] ABSTRACT

A process for the preparation of toner compositions with controlled particle size and selected morphology comprising (i) preparing a pigment dispersion in water, which dispersion is comprised of pigment, ionic surfactant, and optionally a charge control agent;

(ii) shearing the pigment dispersion with a polymeric latex comprised of resin of submicron size, a counterionic surfactant with a charge polarity of opposite sign to that of said ionic surfactant and a nonionic surfactant thereby causing a flocculation or heterocoagulation of the formed particles of pigment, resin and charge control agent, and generating a uniform blend dispersion of solids of resin, pigment, and optional charge control agent in the water and surfactants;

(iii) (a) continuously stirring and heating the above sheared blend to form electrostatically bound toner size aggregates; or (iii) (b) further shearing the above blend to form electrostatically bound well packed aggregates; or (iii) (c) continuously shearing the above blend, while heating to form aggregated flake-like particles;

(iv) heating the above formed aggregated particles about above the Tg of the resin to provide coalesced particles of toner; and optionally (v) separating said toner particles from water and surfactants; and (vi) drying said toner particles.

26 Claims, 5 Drawing Sheets

TONER EMULSION AGGREGATION PROCESS

BACKGROUND OF THE INVENTION

The present invention is generally directed to toner processes, and more specifically to aggregation and coalescence processes for the preparation of toner compositions with certain morphologies. In embodiments, the present invention is directed to the economical preparation of toners without the utilization of the known pulverization and/or classification methods, and wherein toner compositions with an average volume diameter of from about 1 to about 25, and preferably from 1 to about 10 microns and narrow GSD of, for example, from about 1.16 to about 1.30, as measured on the Coulter Counter, can be obtained. Also, the morphology of the toner particles can be tuned, or preselected from like a bunch of grapes morphology through cauliflower, raspberries, potatoes to perfectly spherical particles. The resulting toners can be selected for known electrophotographic imaging and printing processes, including color processes, and lithography. In embodiments, the present invention is directed to a process comprised of dispersing a pigment, and optionally a charge control agent or additive in an aqueous mixture containing an ionic surfactant in amount of from about 0.01 percent (weight percent throughout unless otherwise indicated) to about 10 percent and shearing this mixture at high shear with a latex mixture comprised of suspended resin particles of from, for example, about 0.01 micron to about 2 microns in volume average diameter, in an aqueous solution containing a counterionic surfactant in amounts of from about 0.01 percent to about 10 percent with opposite charge to the ionic surfactant of the pigment dispersion, and nonionic surfactant in an amount of from 0 percent to about 5 percent, thereby causing a flocculation of resin particles, pigment particles and optional charge control particles, followed by (a) stirring at from 250 rpm to 600 rpm, or (b) stirring assisted with heating from about 40° C. to about 5° C. below the resin Tg and preferably 20° C. to 5° C. below the resin Tg, or (c) shearing of the flocculated mixture, for example by attrition at 20 rpm to about 400 rpm, or (d) shearing assisted by heating of the flocculent mixture which is believed to form statically bound aggregates of from about 1 micron to about 10 microns in volume average diameter comprised of resin, pigment, and optionally charge control particles. The morphology of the aforementioned statically bonded aggregated particles can be controlled by adjusting the temperature in the aggregation stage (below the resin Tg), the time of the aggregation, and by the shear. By extending the time of the aggregation and/or increasing the temperature and/or applying the shear, one can more densely pack the submicron particles in the aggregated particles and as a result form more uniform toner particles. The reverse causes formation of the particles with higher fractal dimensions (loosely packed) which upon heating can form particles with some voids or holes. The formation of electrostatically bonded aggregates is followed by coalescence which comprises heating above the resin Tg. It is believed that during the heating stage the components of aggregated particles fuse together to form composite toner particles. The coalescence step (iv) can have an impact on the toner particle morphology. Factors, such as coalescence temperature, time of heating as well as melt flow properties of the polymeric resin, contribute to the toner particle morphology. By increasing the temperature of the coalescence and/or extending the time of heating, the morphology of toner particles can be tuned from "bumpy" structures to smooth surfaces. The morphology can also depend on the melt flow properties of the resin, which is closely related to the type of resin, its molecular weight, Tg, degree of crosslinking, presence of plasticizer, and the like. Also, by increasing the melt flow properties of the polymeric resin, the morphology of the particles can be changed from "bumpy" to smooth and spherical as illustrated herein. In another embodiment thereof, the present invention is directed to an in situ process comprised of first dispersing a pigment, such as HELIOGEN BLUE TM or HOSTAPERM PINK TM, in an aqueous mixture containing a cationic surfactant, such as benzalkonium chloride (SANIZOL B-50 TM), utilizing a high shearing device, such as a Brinkmann Polytron, a microfluidizer or a sonicator, thereafter shearing this mixture with a latex of suspended resin particles, such as poly(styrenebutadiene acrylic acid), poly(styrenebutylacrylate acrylic acid) or PLIOTONE TM a poly(styrene butadiene), and which particles are, for example, of a size ranging from about 0.01 to about 0.5 micron in volume average diameter as measured by the Brookhaven nanosizer, in an aqueous surfactant mixture containing an anionic surfactant, such as sodium dodecylbenzene sulfonate, for example NEOGEN R TM or NEOGEN SC TM, and nonionic surfactant, such as alkyl phenoxy poly(ethylenoxy) ethanol, for example IGEPAL 897 TM or ANTAROX 897 TM, thereby resulting in a flocculation, or heterocoagulation of the resin particles with the pigment particles; and which on further stirring for 1 to about 24 hours, or further stirring while heating or shearing, for example, using the attritor, or shearing while heating, for example, from about 25° C. to about 50° C. results in the formation of statically bound aggregates ranging in size of from about 0.5 micron to about 10 microns in average diameter size as measured by the Coulter Counter (Multisizer II) with a morphology ranging from a bunch of grapes, loosely or densely packed, to flakes where the morphology of the aggregates can be controlled by temperature, shear, and time. Thereafter, heating about 5° C. to about 50° C. above the resin Tg, which Tg is in range of from about 50° C. to about 80° C., to provide for particle fusion or coalescence of the polymer and pigment particles with the morphology controlled by the temperature of coalescence, the time of coalescence and the melt flow properties of the resin; followed by washing with, for example, hot water to remove surfactant, and drying toner particles comprised of resin and pigment with various particle size diameters can be obtained such as from 1 to 12 microns in average volume particle diameter. The aforementioned toners are especially useful for the development of colored images with excellent line and solid resolution, and wherein substantially no background deposits are present.

While not being desired to be limited by theory, it is believed that the flocculation or heterocoagulation is caused by the neutralization of the pigment mixture containing the pigment and cationic surfactant absorbed on the pigment surface with the resin mixture containing the resin particles and anionic surfactant absorbed on the resin particle. Depending on the conditions of this flocculation step such as time, shear and temperature, submicron resin particles and pigment particles will pack in the aggregate more densely or loosely and this will be a factor contributing to their final morphology. Thereafter, heating the aggregates, for example 5° C. to 80° C. above the resin Tg, fuses the aggregated particles or coalesces the particles to enable toner composites of polymer and pigments and optionally charge control agents. The temperature of the coalescence as well as the time for which the aggregated particles were heated above their Tg (step iv) will effect the morphology of the final toner particles, ranging from a bunch of grapes type of morphology to perfectly spherical. Furthermore, in other embodiments the ionic surfactants can be exchanged, such that the pigment mixture contains the pigment particle and anionic surfactant, and the suspended resin particle mixture contains the resin particles and cationic surfactant; followed by the ensuing steps as illustrated herein to enable flocculation by charge neutralization while shearing, and thereby forming statically bound aggregate particles by stirring and heating (below the resin Tg), and thereafter, that is when the aggregates are formed, heating above the resin Tg to form stable toner composite particles.

Of importance with respect to the processes of the present invention in embodiments is controlling the shear time, shear rate and shear temperature, and the aggregation temperature and time since these factors can primarily contribute to the morphology of the aggregated particles and cause more densely or more loosely packed aggregates. Control of the temperature and the time of the coalescence or heating above the resin Tg (step iv) is of importance since these factors can effect the morphology of the final toner particles significantly; by increasing from about 1 hour to about 4 hours the temperature from about 5° C. to about 50° C. above the resin Tg, and/or the time of coalescence from about 1 hour to about 4 hours, the morphology of the particles can be tuned from "bumpy" to smooth. Another factor that can effect the morphology of the toner particles is the melt flow properties of the aggregated resin with increasing, from about 2 to about 10 grams per 10 minutes, the melt flow properties of the resin the surface of the toner particles can be changed from "bumpy" to smooth spherical. One factor contributing to the melt flow is the type of resin, for example polyester, polystyrene/butadiene, or polystyrene/acrylate, the molecular weight of the resin, the Tg, the degree of crosslinking and the presence of plasticizers like polyvinylbuturyal in an amount of from about 1 weight percent to about 20 weight percent.

In reprographic technologies, such as xerographic and ionographic devices, toners with average volume diameter particle sizes of from about 9 microns to about 20 microns are effectively utilized. Moreover, in some xerographic technologies, such as the high volume Xerox Corporation 5090 copier-duplicator, high resolution characteristics and low image noise are highly desired, and can be attained utilizing the small sized toners of the present invention with, for example, an average volume particle diameter of 3 to 11 microns and preferably less than about 7 microns, and with narrow geometric size distribution (GSD) of from about 1.16 to about 1.3. Additionally, in some xerographic systems wherein process color is utilized, such as pictorial color applications, small particle size colored toners of from about 3 to about 9 microns are desired to avoid paper curling. Paper curling is especially observed in pictorial or process color applications wherein three to four layers of toners are transferred and fused onto paper. During the fusing step, moisture is driven off from the paper due to the high fusing temperatures of from about 130° C. to 160° C. applied to the paper from the fuser. Where only one layer of toner is present, such as in black or in highlight xerographic applications, the amount of moisture driven off during fusing is reabsorbed proportionally by paper and the resulting print remains relatively flat with minimal curl. In pictorial color process applications wherein three to four colored toner layers are present, a thicker toner plastic level present after the fusing step inhibits the paper from sufficiently absorbing the moisture lost during the fusing step, and image paper curling results. These and other disadvantages and problems are avoided or minimized with the toners and processes of the present invention. It is preferable to use small toner particle sizes, such as from about 1 to about 7 microns, and with higher pigment loading, such as from about 5 to about 12 percent by weight of toner, such that the mass of toner layers deposited onto paper is reduced to obtain the same quality of image and resulting in a thinner plastic toner layer onto paper after fusing, thereby minimizing or avoiding paper curling. Toners prepared in accordance with the present invention enable the use of lower fusing temperatures, such as from about 120° C. to about 150° C., thereby avoiding or minimizing paper curl. Lower fusing temperatures minimize the loss of moisture from paper, thereby reducing or eliminating paper curl. Furthermore, in process color applications and especially in pictorial color applications, toner to paper gloss matching is highly desirable. Gloss matching is referred to as matching the gloss of the toner image to the gloss of the paper. For example, when a low gloss image of preferably from about 1 to about 30 gloss is desired, low gloss paper is utilized, such as from about 1 to about 30 gloss units as measured by the Gardner Gloss metering unit, and which after image formation with small particle size toners of from about 3 to about 5 microns and fixing thereafter results in a low gloss toner image of from about 1 to about 30 gloss units as measured by the Gardner Gloss metering unit. Alternatively, if higher image gloss is desired, such as from about over 30 to about 60 gloss units as measured by the Gardner Gloss metering unit, higher gloss paper is utilized, such as from about over 30 to about 60 gloss units, and which after image formation with small particle size toners of the present invention of from about 3 to about 5 microns and fixing thereafter results in a higher gloss toner image of from about over 30 to about 60 gloss units as measured by the Gardner Gloss metering unit. The aforementioned toner to paper matching can be attained with small particle size toners such as less than 7 microns and preferably less than 5 microns, such as from about 1 to about 4 microns such that the pile height of the toner layer(s) is considered low.

Numerous processes are known for the preparation of toners, such as, for example, conventional processes wherein a resin is melt kneaded or extruded with a pigment, micronized and pulverized to provide toner particles with very irregular shape with sharp edges, which may not be an optimum morphology from the charging and dry toner flow point of view. With the present invention, tuning of the toner particle morphology can be achieved to enable, for example, selected excellent morphologies desired for superior toner flow and excellent charging properties of the toner particles. Also, in conventional processes wherein a resin is melt kneaded or extruded with a pigment, micronized and pulverized toner particles with an average volume particle diameter of from about 10 microns to about 20 microns and with broad geometric size distribution of from about 1.4 to about 1.7 result. In such processes, it is usually necessary to subject the aforementioned toners to a classification procedure such that the geometric size distribution of from about 1.2 to about 1.4 is attained. Also, in the aforementioned conventional process, low toner yields after classifications may be obtained. Generally, during the preparation of toners with average particle size diameters of from about 11 microns to about 15 microns, toner yields range from about 70 percent to about 85 percent after classification. Additionally, during the preparation of smaller sized toners with particle sizes of from about 7 microns to about 11 microns, lower toner yields are obtained after classification, such as from about 50 percent to about 70 percent. With the processes of the present invention, in embodiments small average particle sizes of, for example, from about 3 microns to about 9, and preferably 5 microns are attained without resorting to classification processes, and wherein narrow geometric size distributions are attained, such as from about 1.16 to about 1.30, and preferably from about 1.16 to about 1.25. High toner yields are also attained such as from about 90 percent to about 98 percent in embodiments. In addition, by the toner particle preparation process of the present invention in embodiments, small particle size toners of from about 3 microns to about 7 microns can be economically prepared in high yields such as from about 90 percent to about 98 percent by weight based on the weight of all the toner material ingredients, such as toner resin and pigment.

There is illustrated in U.S. Pat. No. 4,996,127 a toner of associated particles of secondary particles comprising primary particles of a polymer having acidic or basic polar groups and a coloring agent. The polymers selected for the toners of the '127 patent can be prepared by an emulsion polymerization method, see for example columns 4 and 5 of this patent. In column 7 of this '127 patent, it is indicated that the toner can be prepared by mixing the required amount of coloring agent and optional charge additive with an emulsion of the polymer having an acidic or basic polar group obtained by emulsion polymerization. Also, note column 9, lines 50 to 55, wherein a polar monomer such as acrylic acid in the emulsion resin is necessary, and toner preparation is not obtained without the use, for example, of acrylic acid polar group. In U.S. Pat. No. 4,983,488, there is disclosed a process for the preparation of toners by the polymerization of a polymerizable monomer dispersed by emulsification in the presence of a colorant and/or a magnetic powder to prepare a principal resin component and then effecting coagulation of the resulting polymerization liquid in such a manner that the particles in the liquid after coagulation have diameters suitable for a toner. It is indicated in column 9 of this patent that coagulated particles of 1 to 100, and particularly 3 to 70, are obtained. This process is thus directed to the use of coagulants, such as inorganic magnesium sulfate which results in the formation of particles with wide GSD. Similarly, the aforementioned disadvantages, for example poor GSD are obtained, hence classification is required resulting in low yields as illustrated in U.S. Pat. No. 4,797,339, wherein there is disclosed a process for the preparation of toners by resin emulsion polymerization, wherein similar to the '127 patent polar resins of oppositely charges are selected, and wherein flocculation as in the present invention is not disclosed; and U.S. Pat. No. 4,558,108, wherein there is disclosed a process for the preparation of a copolymer of styrene and butadiene by specific suspension polymerization. Other prior art that may be of interest includes U.S. Pat. Nos. 3,674,736; 4,137,188 and 5,066,560.

The process described in the present application has several advantages as indicated herein including the effective preparation of small toner particles with narrow particle size distribution with the desired morphology which can be tuned for particular xerographic applications.

In U.S. Pat. No. 5,290,654, the disclosure of which is totally incorporated herein by reference, there is illustrated a process for the preparation of toners comprised of dispersing a polymer solution comprised of an organic solvent, and a polyester and homogenizing and heating the mixture to remove the solvent and thereby form toner composites. Additionally, there is disclosed in U.S. Pat. No. 5,278,020, the disclosure of which is totally incorporated herein by reference, a process for the preparation of in situ toners comprising an halogenization procedure which chlorinates the outer surface of the toner and results in enhanced blocking properties. More specifically, this patent application discloses an aggregation process wherein a pigment mixture, containing an ionic surfactant, is added to a resin mixture, containing polymer resin particles of less than 1 micron, nonionic and counterionic surfactant, and thereby causing a flocculation which is dispersed to statically bound aggregates of about 0.5 to about 5 microns in volume diameter as measured by the Coulter Counter, and thereafter heating to form toner composites or toner compositions of from about 3 to about 7 microns in volume diameter and narrow geometric size distribution, as measured by the Coulter Counter, and which exhibit, for example, low fixing temperature of from about 125° C. to about 150° C., and image to paper gloss matching.

In U.S. Pat. No. 5,308,734, the disclosure of which is totally incorporated herein by reference, there is illustrated a process for the preparation of toner compositions which comprises generating an aqueous dispersion of toner fines, ionic surfactant and nonionic surfactant, adding thereto a counterionic surfactant with a polarity opposite to that of said ionic surfactant, homogenizing and stirring said mixture, and heating to provide for coalescence of said toner fine particles.

In U.S. Pat. No. 5,346,797, the disclosure of which is totally incorporated herein by reference there is disclosed a process for the preparation of toner compositions comprising (i) preparing a pigment dispersion in a water, which dispersion is comprised of a pigment, an ionic surfactant and optionally a charge control agent;

(ii) shearing the pigment dispersion with a latex mixture comprised of a counterionic surfactant with a charge polarity of opposite sign to that of said ionic surfactant, a nonionic surfactant and resin particles, thereby causing a flocculation or heterocoagulation of the formed particles of pigment, resin and charge control agent to form electrostatically bounded toner size aggregates; and (iii) heating the statically bound aggregated particles above the Tg to form said toner composition comprised of polymeric resin, pigment and optionally a charge control agent.

In U.S. Pat. No. 5,370,463, filed concurrently herewith, the disclosure of which is totally incorporated herein by reference, there is illustrated a process for the preparation of toner compositions with controlled particle size comprising:

(i) preparing a pigment dispersion in water, which dispersion is comprised of pigment, an ionic surfactant and an optional charge control agent;

(ii) shearing at high speeds the pigment dispersion with a polymeric latex comprised of resin, a counterionic surfactant with a charge polarity of opposite sign to that of said ionic surfactant, and a nonionic surfactant thereby forming a uniform homogeneous blend dispersion comprised of resin, pigment, and optional charge agent;

(iii) heating the above sheared homogeneous blend below about the glass transition temperature (Tg) of the resin while continuously stirring to form electrostatically bound toner size aggregates with a narrow particle size distribution;

(iv) heating the statically bound aggregated particles above about the Tg of the resin particles to provide coalesced toner comprised of resin, pigment and optional charge control agent, and subsequently optionally accomplishing (v) and (vi);

(v) separating said toner; and (vi) drying said toner.

In U.S. Pat. No. 5,344,738, filed concurrently herewith, the disclosure of which is totally incorporated herein by reference, there is illustrated a process for the preparation of toner compositions with a volume median particle size of from about 1 to about 25 microns, which process comprises:

(i) preparing by emulsion polymerization a charged polymeric latex of submicron particle size;

(ii) preparing a pigment dispersion in water, which dispersion is comprised of a pigment, an effective amount of cationic flocculant surfactant, and optionally a charge control agent;

(iii) shearing the pigment dispersion (ii) with a polymeric latex (i) comprised of resin, a counterionic surfactant with a charge polarity of opposite sign to that of said ionic surfactant thereby causing a flocculation or heterocoagulation of the formed particles of pigment, resin and charge control agent to form a high viscosity gel in which solid particles are uniformly dispersed;

(iv) stirring the above gel comprised of latex particles, and oppositely charged pigment particles for an effective period of time to form electrostatically bound relatively stable toner size aggregates with narrow particle size distribution; and (v) heating the electrostatically bound aggregated particles at a temperature above the resin glass transition temperature (Tg) thereby providing said toner composition comprised of resin, pigment and optionally a charge control agent.

In copending patent application U.S. Ser. No. 083,157, filed concurrently herewith, the disclosure of which is totally incorporated herein by reference, there is illustrated a process for the preparation of toner compositions with controlled particle size comprising:

(i) preparing a pigment dispersion in water, which dispersion is comprised of a pigment, an ionic surfactant in amounts of from about 0.5 to about 10 percent by weight of water, and an optional charge control agent;

(ii) shearing the pigment dispersion with a latex mixture comprised of a counterionic surfactant with a charge polarity of opposite sign to that of said ionic surfactant, a nonionic surfactant and resin particles, thereby causing a flocculation or heterocoagulation of the formed particles of pigment, resin and charge control agent;

(iii) stirring the resulting sheared viscous mixture of (ii) at from about 300 to about 1,000 revolutions per minute to form electrostatically bound substantially stable toner size aggregates with a narrow particle size distribution;

(iv) reducing the stirring speed in (iii) to from about 100 to about 600 revolutions per minute and subsequently adding further anionic or nonionic surfactant in the range of from about 0.1 to about 10 percent by weight of water to control, prevent, or minimize further growth or enlargement of the particles in the coalescence step (iii); and (v) heating and coalescing from about 5° to about 50° C. above about the resin glass transition temperature, Tg, which resin Tg is from between about 45° to about 90° C. and preferably from between about 50° and about 80° C., the statically bound aggregated particles to form said toner composition comprised of resin, pigment and optional charge control agent.

In U.S. Pat. No. 5,364,729, filed concurrently herewith, the disclosure of which is totally incorporated herein by reference, there is illustrated a process for the preparation of toner compositions comprising:

(i) preparing a pigment dispersion, which dispersion is comprised of a pigment, an ionic surfactant, and optionally a charge control agent;

(ii) shearing said pigment dispersion with a latex or emulsion blend comprised of resin, a counterionic surfactant with a charge polarity of opposite sign to that of said ionic surfactant and a nonionic surfactant;

(iii) heating the above sheared blend below about the glass transition temperature (Tg) of the resin to form electrostatically bound toner size aggregates with a narrow particle size distribution; and (iv) heating said bound aggregates above about the Tg of the resin.

In copending patent application U.S. Ser. No. 083,116, filed concurrently herewith, the disclosure of which is totally incorporated herein by reference, there is illustrated a process for the preparation of toner compositions comprising (i) preparing a pigment dispersion in water, which dispersion is comprised of pigment, a counterionic surfactant with a charge polarity of opposite sign to the anionic surfactant of (ii) and optionally a charge control agent;

(ii) shearing the pigment dispersion with a latex comprised of resin, anionic surfactant, nonionic surfactant, and water; and wherein the latex solids content, which solids are comprised of resin, is from about 50 weight percent to about 20 weight percent thereby causing a flocculation or heterocoagulation of the formed particles of pigment, resin and optional charge control agent; diluting with water to form a dispersion of total solids of from about 30 weight percent to 1 weight percent, which total solids are comprised of resin, pigment and optional charge control agent contained in a mixture of said nonionic, anionic and cationic surfactants;

(iii) heating the above sheared blend at a temperature of from about 5° to about 25° C. below about the glass transition temperature (Tg) of the resin while continuously stirring to form toner sized aggregates with a narrow size dispersity; and (iv) heating the electrostatically bound aggregated particles at a temperature of from about 5° to about 50° C. above about the Tg of the resin to provide a toner composition comprised of resin, pigment and optionally a charge control agent.

Toner particles with mechanical stability for extended time periods to withstand the development system in xerographic processes, and more spherical and more densely packed toner particles are desired. From a charging standpoint, a bumpy type of toner morphology is preferred and from a toner flow point of view, it is believed that spherical particles are preferable. These and other advantages are achievable with the processes of the present invention and more specifically these processes provide a method for the modification or tuning of the morphology of toner particles. This tuning of the morphology can be achieved by adjusting the processing conditions, such as temperature, time and shear, as well as selecting the proper polymeric materials with desired melt flow properties, such as about 20 to about 50 grams/10 minutes.

SUMMARY OF THE INVENTION

It is an object of the present invention to provide toner processes with many of the advantages illustrated herein.

In another object of the present invention there are provided simple and economical processes for the direct preparation of black and colored toner compositions with, for example, excellent pigment dispersion and narrow GSD and with controlled or preselected toner particle morphology.

In another object of the present invention there are provided simple and economical in situ processes for black and colored toner compositions by an aggregation process, comprised of (i) preparing a positively charged pigment dispersion in water, which dispersion is comprised of a pigment an ionic surfactant and optionally a charge control agent; (ii) shearing the pigment dispersion with a negatively charged polymeric latex comprised of resin particles of submicron size, for example 0.01 to about 1, a counterionic surfactant with a charge polarity of opposite sign to that of said ionic surfactant and a nonionic surfactant thereby causing a flocculation or heterocoagulation of the formed particles of pigment, resin and charge control agent to form a uniform dispersion of solids in the water and surfactant; (iii) (a) continuously stirring the above sheared blend, to form electrostatically bound toner size aggregates with the morphology of grapes; (iii) (b) continuously stirring and heating the above sheared blend to form electrostatically bound toner size aggregates with the morphology of grapes; (iii) (c) continuously shearing the above blend, for added time to form electrostatically bound well packed aggregates; or (iii) (d) continuously shearing the above blend, while heating to form the aggregated particles in the form of "flakes"; (iv) heating the statically bound aggregated particles above the Tg of the resin particles, which Tg is in range of about 50° to about 80° C. for a time of from about 30 minutes to about 10 hours to provide coalesced particles of toner with the desired morphology; (v) separating said toner particles from water and surfactants by filtration; and (vi) drying said toner particles.

In a further object of the present invention there is provided a process for the preparation of toners with an average particle volume diameter of from between about 1 to about 20 microns, and preferably from about 1 to about 7 microns, and with a narrow GSD of from about 1.2 to about 1.3 and preferably from about 1.16 to about 1.25 as measured by a Coulter Counter.

In a further object of the present invention there is provided a process for the preparation of toners with a morphology, which can be controlled in a wide range from a "bunch of grapes" to "raspberries", "cauliflowers", "flakes", "potatoes" to perfect "spheres".

In a further object of the present invention there is provided a process for the preparation of toner compositions with a morphology which can be controlled by the shear time and rate applied in the blending of the polymeric latex with the pigment dispersion step (ii).

In a further object of the present invention there is provided a process for the preparation of toner compositions with a morphology which can be controlled by the time, the temperature and optionally the shear applied in the aggregation step (iii).

In a further object of the present invention there is provided a process for the preparation of toner compositions with a morphology which can be controlled by the temperature and the time of the coalescence step or fusing of the aggregated resin and pigment particles to form toner composite step (iv).

In a further object of the present invention there is provided a process for the preparation of toner compositions with a morphology which can be controlled by the melt flow properties of the aggregated resin particles.

In a further object of the present invention there is provided a process for the preparation of toner compositions with the melt flow properties, which will depend on type of resin, their molecular weights, Tg, degree of crosslinking and optional presence of plasticizers.

In a further object of the present invention there is provided a process for the preparation of toner compositions with toner particles stable enough to withstand development in xerographic systems.

In a further object of the present invention there is provided a process for the preparation of toner compositions with a morphology that will permit acceptable toner charging properties.

In a further object of the present invention there is provided a process for the preparation of toner compositions with a morphology that will provide excellent toner flow properties.

Moreover, in a further object of the present invention there is provided a process for the preparation of toner compositions which after fixing to paper substrates result in images with a gloss of from 20 GGU (Gardner Gloss Units) up to 70 GGU as measured by Gardner Gloss meter matching of toner and paper.

In another object of the present invention there are provided a toner with resin and pigment in high yields of from about 90 percent to about 100 percent by weight of toner without resorting to classification.

In yet another object of the present invention there are provided toner compositions with low fusing temperatures of from about 110° C. to about 150° C. and with excellent blocking characteristics at from about 50° C. to about 60° C.

Moreover, in another object of the present invention there are provided toner compositions with a high projection efficiency such as from about 75 to about 95 percent efficiency as measured by the Match Scan II spectrophotometer available from Milton-Roy.

In a further object of the present invention there are provided toner compositions which result in minimal, low or no paper curl.

Another object of the present invention resides in processes for the preparation of small sized toner particles with narrow GSDs, and excellent pigment dispersion by the aggregation of latex particles with pigment particles dispersed in water and surfactant, and wherein the aggregated particles of toner size can then be caused to coalesce by, for example, heating.

These and other objects of the present invention are accomplished in embodiments by the provision of toners and processes thereof. In embodiments of the present invention, there are provided processes for the economical direct preparation of toner compositions by improved flocculation or heterocoagulation and coalescence processes, and wherein the temperature of the coalescence, heating above the resin Tg, the time of coalescence, the temperature and time of aggregation, and shear time and rate, and resin melt flow properties, are the primary factors contributing to the type of morphology of the final toner particles.

DETAILED DESCRIPTION OF THE INVENTION

Figure 1:
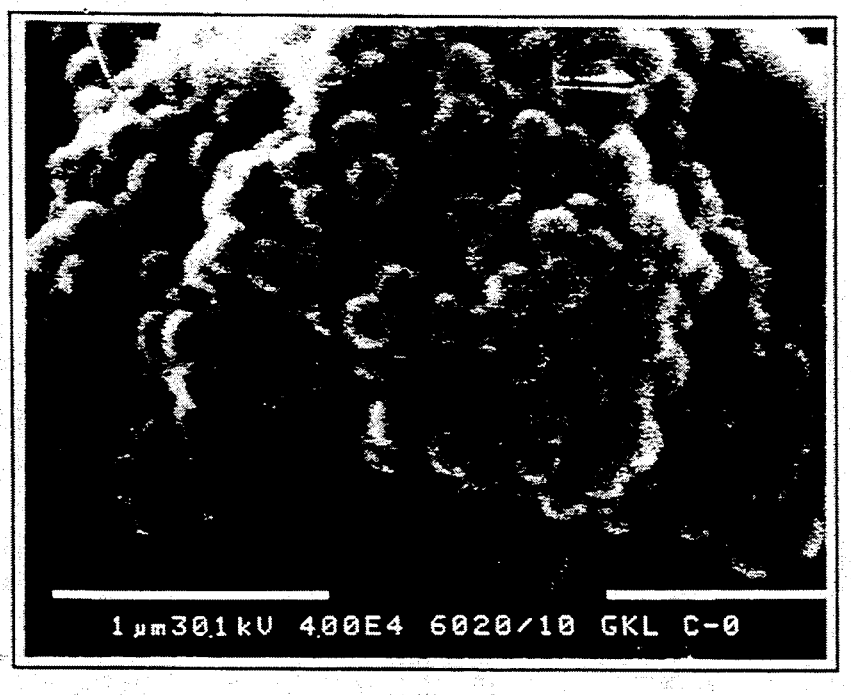
FIGS. 1 to 9 represent copies of microphotographs for particles and toners obtained with the processes of the present invention.

In embodiments, the present invention is directed to processes for the preparation of toner compositions which comprise initially attaining or generating an ionic pigment dispersion, for example dispersing an aqueous mixture of pigment or pigments, such as carbon black like REGAL 330®, phthalocyanine, quinacridone or RHODAMINE B™ type with a cationic surfactant such as benzalkonium chloride, by utilizing a high shearing device, such as a Brinkmann Polytron, a sonicator, a microfluidizer or an attritor, thereafter shearing this mixture by utilizing a shearing device, such as a Brinkmann Polytron or attritor with a suspended resin mixture comprised of polymer particles, such as poly(styrene-co-butadiene-co-acrylic acid) or poly(styrene-co-butylacrylate-co-acrylic acid), and wherein the particle size of the suspended resin mixture ranges from 0.01 to about 0.5 micron in an aqueous surfactant mixture containing an anionic surfactant, such as sodium dodecylbenzene sulfonate and nonionic surfactant; resulting in a flocculation, or heterocoagulation of the resin particles with the pigment particles caused by the neutralization of anionic surfactant absorbed on the resin particles with the oppositely charged cationic surfactant absorbed on the pigment particle; and further stirring the mixture using a mechanical stirrer at 250 to 500 rpm, or further stirring while heating below the resin Tg, for example 40° C. to 5° C. below the resin Tg, or further shearing, for example, in the attritor, or further shearing with heating; and allowing the formation of electrostatically stabilized aggregates ranging from about 0.5 micron to about 10 microns with the morphology ranging from a bunch of grapes to flakes; followed by heating above the resin Tg, for example 5° C. to 50° C. above, to cause the coalescence of the latex, pigment particles and to tune the morphology of the toner particles by changing the temperature of the coalescence and/or the time of coalescence which will allow the achievement of toner morphology particles ranging from raspberries, cauliflowers, flakes, potatoes to spheres; followed by washing with, for example, hot water to remove surfactants; and drying, such as by use of an Aeromatic fluid bed dryer, freeze dryer, or spray dryer; and whereby toner particles comprised of resin and pigment with various particle morphologies such as raspberries, cauliflowers, flakes, potatoes, and spheres can be obtained.

Embodiments of the present invention include a process for the preparation of toner compositions comprised of resin and pigment comprising (i) preparing a pigment dispersion in water, which dispersion is comprised of a pigment an ionic surfactant and optionally a charge control agent;

(ii) shearing the pigment dispersion with a polymeric latex comprised of resin particles of submicron size, a counterionic surfactant with a charge polarity of opposite sign to that of said ionic surfactant and a nonionic surfactant thereby causing a flocculation or heterocoagulation of the formed particles of pigment, resin and charge control agent to form a uniform dispersion of solids in the water and surfactants;

(iii) (a) continuously stirring the above sheared blend, to form electrostatically bounded toner size aggregates with a grape like morphology; or (iii) (b) continuously stirring and heating the above sheared blend, to form electrostatically bound toner size aggregates with the morphology of grapes; or (iii) (c) shearing the above blend, for added time to form electrostatically bound well packed aggregates; or (iii) (d) shearing the above blend, while heating to form the aggregated particles in the form of flakes;

(iv) heating the statically bound aggregated particles 5° C. to 50° C. above the Tg of the resin particles (Tg of resin being in range of 50° C. to 80° C.) for the time of from about 30 minutes to about 10 hours to provide a coalesced particles of toner comprised of polymeric resin and pigment, with the desired morphology;

(v) separating said toner particles from water and surfactant by filtration; and (vi) drying said toner particles; a process for the preparation of toner compositions with controlled particle size and morphology; or (i) preparing a pigment dispersion in water, which dispersion is comprised of a pigment an ionic surfactant and optionally a charge control agent;

(ii) shearing the pigment dispersion with a negatively charged polymeric latex comprised of resin of submicron size, a counterionic surfactant with a charge polarity of opposite sign to that of said ionic surfactant and a nonionic surfactant thereby causing a flocculation or heterocoagulation of the formed particles of pigment, resin and charge control agent to form a uniform dispersion of solids in water and surfactant;

(iii) (a) continuously stirring and heating the above sheared blend to form electrostatically bound toner size aggregates; or (iii) (b) further shearing the above blend to form electrostatically bound well packed aggregates; or (iii) (c) continuously shearing the above blend, while heating to form aggregated flake like particles;

(iv) heating the formed statically bound aggregated particles above the Tg of the resin particles to provide coalesced particles of toner;

(v) separating said toner particles from water and surfactant by filtration; and a process for the preparation of toner compositions comprising:

(i) preparing a positively charged pigment dispersion in water, which dispersion is comprised of a pigment and an ionic surfactant;

(ii) shearing the pigment dispersion with a polymeric latex comprised of resin of submicron size of from about 0.05 to about 1 micron in average volume diameter, a counterionic surfactant with a charge polarity of opposite sign to that of said ionic surfactant and a nonionic surfactant thereby causing a flocculation or heterocoagulation of the formed particles of pigment, and resin to form a uniform dispersion of solids in the water and surfactant;

(iii) (a) continuously stirring and heating the above sheared blend to form electrostatically bound toner size aggregates with a grape like the morphology; or (iii) (b) shearing the above blend to form electrostatically bound densely packed aggregates; or (iii) (c) shearing the above blend, while heating to form the aggregated particles in the form of flakes; and (iv) heating the statically bound aggregated particles above the Tg of the resin particles to provide a coalesced particles of toner with the desired morphology.

Also, in embodiments the present invention is directed to processes for the preparation of toner compositions which comprises (i) preparing an ionic pigment mixture by dispersing a pigment such as carbon Black, like REGAL 330®, HOSTAPERM PINK TM, or PV FAST BLUE TM of from about 2 to about 10 percent by weight of toner in an aqueous mixture containing a cationic surfactant such as dialkylbenzene dialkylammonium chloride, like SANIZOL B-50 TM available from Kao or MIRAPOL TM available from Alkaril Chemicals, and from about 0.5 to about 2 percent by weight of water, utilizing a shearing device, such as a Brinkmann Polytron or IKA homogenizer, at a speed of from about 3,000 revolutions per minute to about 10,000 revolutions per minute for a duration of from about 1 minute to about 120 minutes, or attritor with ball bearings; (ii) adding the aforementioned ionic pigment mixture to an aqueous suspension of resin particles comprised of, for example, poly(styrene-co-butylacrylate), PLIOTONE TM or poly(styrene-co-butadiene), and which resin particles are present in various effective amounts such as from about 0 percent to about 80 percent by weight of the aqueous mixture, and wherein the polymer resin latex particle size is from about 0.1 micron to about 3 microns in volume average diameter, and counterionic surfactant such as an anionic surfactant like sodium dodecyl sulfate, dodecylbenzene sulfonate or NEOGEN R TM from about 0.5 to about 2 percent by weight of water, a nonionic surfactant such polyethylene glycol or polyoxyethylene glycol nonyl phenyl ether or IGEPAL 897 TM obtained from GAF Chemical Company, from about 0.5 to about 3 percent by weight of water, thereby causing a flocculation or heterocoagulation of pigment, charge control additive and resin particles; (iii) diluting the mixture with water from about 50 percent solids to about 15 percent solids in water; (iv) homogenizing the resulting flocculent mixture with a high shearing device, such as a Brinkmann Polytron or IKA homogenizer, at a speed of from about 3,000 revolutions per minute to about 10,000 revolutions per minute for a duration of from about 1 minute to about 120 minutes, or homogenizing using an attritor with ball bearings operating at speed from 100 to 400 revolutions per minute for a period of 2 hours to 64 hours thereby resulting in a homogeneous mixture of latex and pigment and further stirring with a mechanical stirrer from about 250 to 500 rpm, or further stirring while heating below the resin Tg at, for example 20° C. to 5° C. below the resin Tg, at temperatures of 35° C. to 50° C., or further shearing, for example, in the attritor from about 20 rpm to about 400 rpm, or further shearing with heating, for example 20° C. to 5° C. below resin Tg; to form electrostatically stable aggregates of from about 0.5 micron to about 5 microns in average volume diameter; (v) adding of additional anionic surfactant or nonionic surfactant in the amount of from 0.5 percent to 5 percent by weight of the water to stabilize the aggregates formed in step (vi), heating the statically bound aggregate composite particles of from about 60° C. to about 95° C. for a duration of about 60 minutes to about 600 minutes to form toner sized particles of from about 3 microns to about 20 microns in volume average diameter and with a geometric size distribution of from about 1.2 to about 1.3 as measured by the Coulter Counter and with a morphology ranging from bunch of grapes, to flakes, cauliflowers, raspberries, potatoes to spheres; and (vi) isolating the toner sized particles by washing, filtering and drying thereby providing composite toner particles composed of resin and pigment with the desired morphology. Flow additives to improve flow characteristics and charge additives to improve charging characteristics may then optionally be added by blending with the formed toner, such additives including AEROSILS® or silicas, metal oxides like tin, titanium and the like, metal salts of fatty acids like zinc stearate, and which additives are present in various effective amounts, such as from about 0.1 to about 10 percent by weight of the toner.

One method of obtaining the pigment dispersion can depend on the form of the pigment utilized. In some instances, pigments available in the wet cake form, or concentrated form containing water can be easily dispersed utilizing an homogenizer or stirring. In other instances, pigments are available in a dry form, whereby a dispersion in water is preferably effected by microfluidizing using, for example, a M-110 microfluidizer and passing the pigment dispersion from 1 to 10 times through the chamber of the microfluidizer, or by sonication such as using a Branson 700 sonicator, with the optional addition of dispersing agents such as the aforementioned ionic or nonionic surfactants.

In embodiments, the present invention relates to a process for the preparation of toner compositions with controlled particle size and morphology comprising:

(i) preparing a pigment dispersion in a water, which dispersion is comprised of a pigment, an ionic surfactant and optionally a charge control agent;

(ii) shearing the pigment dispersion with a latex blend comprised of resin particles, a counterionic surfactant with a charge polarity of opposite sign to that of said ionic surfactant and a nonionic surfactant thereby causing a flocculation or heterocoagulation of the formed particles of pigment, resin and charge control agent to form a uniform dispersion of solids in the system of water and surfactants;

(iii) (a) continuously stirring the above sheared blend, to form electrostatically bound toner size aggregates with the morphology of grapes; or (iii) (b) continuously stirring and heating the above sheared blend to form electrostatically bound toner size aggregates with the morphology of grapes; or (iii)(c) shearing further the above blend to form electrostatically bound well packed aggregates; or (iii) (d) shearing further the above blend, while heating to form aggregated particles;

(iv) heating the statically bound aggregated particles at temperatures 5° C. to 50° C. above the Tg of the resin to provide a mechanically stable, morphologically useful form of the said toner composition comprised of polymeric resin, pigment and optionally a charge control agent;

(v) separating said toner particles from water by filtration; and (vi) drying said toner particles.

Illustrative examples of specific resins selected for the process of the present invention include known polymers selected from the group consisting of poly(styrene-butadiene), poly(para-methyl styrene-butadiene), poly(meta-methyl styrene-butadiene), poly(alpha-methyl styrene-butadiene), poly(methylmethacrylate-butadiene), poly(ethylmethacrylate-butadiene), poly(-propylmethacrylate-butadiene), poly(butylmethacrylate-butadiene), poly(methylacrylate-butadiene), poly(ethylacrylate-butadiene), poly(propylacrylate-butadiene), poly(butylacrylate-butadiene), poly(styrene-isoprene), poly(para-methyl styrene-isoprene), poly(meta-methyl styrene-isoprene), poly(alpha-methylstyrene-isoprene), poly(methylmethacrylate-isoprene), poly(ethylmethacrylate-isoprene), poly(propylmethacrylate-isoprene), poly(butylmethacrylate-isoprene), poly(methylacrylate-isoprene), poly(ethylacrylate-isoprene), poly(propylacrylate-isoprene), and poly(butylacrylate-isoprene), terpolymers such as poly(styrene-butadiene-acrylic acid), poly(styrene-butadiene-methacrylic acid), PLIOTONE TM available from Goodyear, polyethylene-terephthalate, polypropylene-terephthalate, polybutylene-terephthalate, polypentylene-terephthalate, polyhexalene-terephthalate, polyheptadene-terephthalate, polyoctalene-terephthalate, POLYLITE TM (Reichhold Chemical Inc), PLASTHALL TM (Rohm & Hass), CYGAL TM (American Cyanamide), ARMCO TM (Armco Composites), CELANEX TM (Celanese Eng), RYNITE TM (DuPont), STYPOL TM. The resin particles selected, which generally can be in embodiments styrene acrylates, styrene butadienes, styrene methacrylates, or polyesters, are present in various effective amounts, such as from about 85 weight percent to about 98 weight percent of the toner, and can be of small average particle size such as from about 0.01 micron to about 1 micron in average volume diameter as measured by the Brookhaven nanosize particle analyzer.

The resin particles selected for the process of the present invention are preferably prepared by emulsion polymerization techniques, and the monomers utilized in such processes can be selected from the group consisting of styrene, acrylates, methacrylates, butadiene, isoprene, and optionally acid or basic olefinic monomers such as acrylic acid, methacrylic acid, acrylamide, methacrylamide, quaternary ammonium halide of dialkyl or trialkyl acrylamides or methacrylamide, vinylpyridine, vinylpyrrolidone, vinyl-N-methylpyridinium chloride and the like. The presence of acid or basic groups is optional and such groups can be present in various amounts of from about 0.1 to about 10 percent by weight of the polymer resin. Known chain transfer agents, for example dodecanethiol (1 to 10 percent) or carbon tetrabromide in effective amounts, such as from about 1 to about 10 percent, can also be selected when preparing resin particles by emulsion polymerization. Other process of obtaining resin particles of from about 0.01 micron to about 3 microns can be selected from polymer microsuspension process, such as disclosed in U.S. Pat. No. 3,674,736, the disclosure of which is totally incorporated herein by reference, polymer solution: microsuspension process, such as disclosed in U.S. Pat. No. 5,290,654, the disclosure of which is totally incorporated herein by reference, mechanical grinding processes, or other known processes.

Various known colorants or pigments present in the toner in an effective amount of, for example, from about 1 to about 25 percent by weight of the toner, and preferably in an amount of from about 1 to about 15 weight percent that can be selected include carbon black like REGAL 330®, REGAL 660®, REGAL 400®, REGAL 400R®, and REGAL 330R®, REGAL 660R®, and other equivalent black pigments. As colored pigments there can be selected known cyan, magenta, yellow. Specific examples of pigments include phthalocyanine HELIOGEN BLUE L6900 TM, D6840 TM, D7080 TM, D7020 TM, PYLAM OIL BLUE TM, PYLAM OIL YELLOW TM, PIGMENT BLUE 1 TM available from Paul Uhlich & Company, Inc., PIGMENT VIOLET 1 TM, PIGMENT RED 48 TM, LEMON CHROME YELLOW DCC 1026 TM, E.D. TOLUIDINE RED TM and BON RED C TM available from Dominion Color Corporation, Ltd., Toronto, Ontario, NOVAperm YELLOW FGL TM, HOSTAPERM PINK E TM from Hoechst, and CINQUASIA MAGENTA TM available from E. I. DuPont de Nemours & Company, and the like. Generally, colored pigments that can be selected are cyan, magenta, or yellow pigments. Examples of magenta materials that may be selected as pigments include, for example, 2,9-dimethyl-substituted quinacridone and anthraquinone dye identified in the Color Index as CI 60710, CI Dispersed Red 15, diazo dye identified in the Color Index as CI 26050, CI Solvent Red 19, and the like. Illustrative examples of cyan materials that may be used as pigments include copper tetra(octadecyl sulfonamido) phthalocyanine, x-copper phthalocyanine pigment listed in the Color Index as CI 74160, CI Pigment Blue, and Anthrathrene Blue, identified in the Color Index as CI 69810, Special Blue X-2137, and the like; while illustrative examples of yellow pigments that may be selected are diarylide yellow 3,3-dichlorobenzidene acetoacetanilides, a monoazo pigment identified in the Color Index as CI 12700, CI Solvent Yellow 16, a nitrophenyl amine sulfonamide identified in the Color Index as Foron Yellow SE/GLN, CI Dispersed Yellow 33 2,5-dimethoxy-4-sulfonanilide phenylazo-4'-chloro-2,5-dimethoxy acetoacetanilide, and Permanent Yellow FGL. The pigments selected are present in various effective amounts, such as from about 1 weight percent to about 65 weight and preferably from about 2 to about 12 percent of the toner.

The toner may also include known charge additives in effective amounts of, for example, from 0.1 to 5 weight percent such as alkyl pyridinium halides, bisulfates, the charge control additives of U.S. Pat. Nos. 3,944,493; 4,007,293; 4,079,014; 4,394,430 and 4,560,635, which illustrates a toner with a distearyl dimethyl ammonium methyl sulfate charge additive, the disclosures of which are totally incorporated herein by reference, and the like.

Surfactants in amounts of, for example, 0.01 to about 25 weight percent in embodiments include, for example, nonionic surfactants such as dialkylphenoxypoly(ethyleneoxy) ethanol (available from Rhone-Poulenac as IGEPAL CA-210 TM, IGEPAL CA-520 TM, IGEPAL CA-720 TM, IGEPAL CO-890 TM, IGEPAL CO-720 TM, IGEPAL CO-290 TM, IGEPAL CA-210 TM, ANTAROX 890 TM and ANTAROX 897 TM. An effective concentration of the nonionic surfactant is, for example, from about 0.01 to about 10 percent by weight, and preferably from about 0.1 to about 5 percent by weight of monomers used to prepare the copolymer resin.

Examples of anionic surfactants include for example, sodium dodecyl sulfate (SDS), sodium dodecylbenzene sulfonate, sodium dodecylnaphthalene sulfate, dialkyl benzenealkyl, sulfates and sulfonates, abitic acid, available from Aldrich, NEOGEN R TM, NEOGEN SC TM obtained from Kao, and the like. An effective concentration of the anionic surfactant generally employed is, for example, from about 0.01 to about 10 percent by weight, and preferably from about 0.01 to about 5 percent by weight of monomers used to prepare the copolymer resin particles.

Examples of the cationic surfactants selected for the toners and processes of the present invention include, for example, dialkyl benzenealkyl ammonium chloride, lauryl trimethyl ammonium chloride, alkylbenzyl methyl ammonium chloride, alkyl benzyl dimethyl ammonium bromide, benzalkonium chloride, cetyl pyridinium bromide, $C_{12}$, $C_{15}$, $C_{17}$, trimethyl ammonium bromides, halide salts of quaternized polyoxyethylalkylamines, dodecylbenzyl triethyl ammonium chloride, MIRAPOL TM and ALKAQUAT TM available from Alkaril Chemical Company, SANIZOL TM (benzalkonium chloride), available from Kao Chemicals, and the like, and mixtures thereof. This surfactant is utilized in various effective amounts, such as for example from about 0.01 percent to about 5 percent by weight of water. Preferably, the molar ratio of the cationic surfactant used for flocculation to the anionic surfactant used in the latex preparation is in the range of from about 0.5 to 4, and preferably from 0.5 to 2.

Examples of the surfactant, which are added to the aggregated particles to freeze or retain particle size and GSD achieved in the aggregation, can be selected from the anionic surfactants, such as sodium dodecylbenzene sulfonate, sodium dodecylnaphthalene sulfate, dialkyl benzenealkyl, sulfates and sulfonates, abitic acid, available from Aldrich, NEOGEN R TM, NEOGEN SC TM obtained from KAO, and the like. These surfactants can also be selected from nonionic surfactants, such as polyoxyethylene cetyl ether, polyoxyethylene lauryl ether, polyoxyethylene octyl ether, polyoxyethylene octylphenyl ether, polyoxyethylene oleyl ether, polyoxyethylene sorbitan monolaurate, polyoxyethylene stearyl ether, polyoxyethylene nonylphenyl ether, dialkylphenoxypoly(ethyleneoxy) ethanol (available from Rhone-Poulenac as IGEPAL CA-210 TM, IGEPAL CA-520 TM, IGEPAL CA-720 TM, IGEPAL CO-890 TM, IGEPAL CO-720 TM, IGEPAL CO-290 TM, IGEPAL CA-210 TM, ANTAROX 890 TM and ANTAROX 897 TM) polyvinyl alcohol, polyacrylic acid, methalose, methyl cellulose, ethyl cellulose, propyl cellulose, hydroxy ethyl cellulose, and carboxy methyl cellulose. An effective concentration of the anionic or nonionic surfactant generally employed as a freezing agent or stabilizing agent is, for example, from about 0.01 to about 10 percent by weight, and preferably from about 0.5 to about 5 percent by weight of the total weight of the aggregated mixture comprised of resin latex, pigment particles, water, ionic and nonionic surfactants.

Surface additives that can be added to the toner compositions after washing or drying include, for example, metal salts, metal salts of fatty acids, colloidal silicas, mixtures thereof, and the like, which additives are usually present in an amount of from about 0.1 to about 2 weight percent, reference U.S. Pat. Nos. 3,590,000; 3,720,617; 3,655,374 and 3,983,045, the disclosures of which are totally incorporated herein by reference. Preferred additives include zinc stearate and AEROSIL R972 ® available from Degussa in amounts of from 0.1 to 2 percent, which can be added during the aggregation process or blended into the formed toner product.

Developer compositions can be prepared by mixing the toners obtained with the processes of the present invention with known carrier particles, including coated carriers, such as steel, ferrites, and the like, reference U.S. Pat. Nos. 4,937,166 and 4,935,326, the disclosures of which are totally incorporated herein by reference, for example from about 2 percent toner concentration to about 8 percent toner concentration.

The following Examples are being submitted to further define various species of the present invention. These Examples are intended to be illustrative only and are not intended to limit the scope of the present invention. Also, parts and percentages are by weight unless otherwise indicated.

The following Examples I and II illustrate the temperature of coalescence or heating above the resin Tg (step iv) as a factor controlling the morphology of the toner particles.

EXAMPLE I

Pigment dispersion: 13 grams of dry pigment PV FAST BLUE TM and 5.85 grams of cationic surfactant alkylbenzyldimethyl ammonium chloride (SANIZOL B-50 TM) were dispersed in 400 grams of water using an ultrasonic probe.

A polymeric latex was prepared by the emulsion polymerization of styrene/butylacrylate/acrylic acid (82/18/2 parts) in a nonionic/anionic surfactant solution (NEOGEN R TM/IGEPAL CA 897 TM, 3 percent) as follows. 352 Grams of styrene, 48 grams of butylacrylate, 8 grams of acrylic acid, and 12 grams of dodecanethiol were mixed with 600 milliliters of deionized water in which 9 grams of sodium dodecyl benzene sulfonate anionic surfactant (NEOGEN R TM which contains 60 percent of active component), 8.6 grams of polyoxyethylene nonyl phenyl ether—nonionic surfactant (ANTAROX 897 TM, 70 percent active), and 4 grams of ammonium persulfate initiator were dissolved. The resulting emulsion was then polymerized at 70° C. for 8 hours. The resulting latex contained 40 percent of solids; the Tg of the latex dry sample was 53.1° C., as measured on DuPont DSC; $M_w$=20,000, and $M_n$=5,800 as determined on Hewlett Packard GPC. The zeta potential as measured on Pen Kem Inc. Laser Zee Meter was −80 millivolts. The particle size of the latex as measured on Brookhaven BI-90 Particle Nanosizer was 163 nanometers. The aforementioned latex was then selected for the toner preparation of Example I.

PREPARATION OF TONER SIZE PARTICLES:

Preparation of the aggregated particles: a dispersion of 13 grams of PV FAST TM pigment in 5.85 grams of SANIZOL B-50 TM and 400 grams of deionized water was added simultaneously with 650 grams of the above latex into the SD41 continuous stirring device containing 600 grams of deionized water. The anionic latex and pigment dispersion in the cationic surfactant were well mixed by the continuous pumping through the high shear chamber operating at 10,000 rpm for 8 minutes. This blend was than transferred into a kettle placed in the heating mantle and equipped with the temperature probe and mechanical stirrer, and it was aggregated at 35° C. for 3 days, while stirring at 400 rpm. The particle size of the aggregates measured using the Coulter Counter was as follows: 4.7 microns average volume diameter (GSD=1.26). The morphology of these particles resembles a bunch of grapes (See micrograph 1, FIG. 1).

Coalescence of aggregated particles—coalescence at 65° C. for 3 hours: after aggregation, the temperature in the kettle was raised to 65° C. and the contents of the kettle were stirred at this temperature for 3 hours. Coalesced toner particles were obtained. The toner particles were washed by filtration using hot water (50° C.) and dried on a freeze dryer. The resulting toner particles were comprised of poly(styrene-co-butylacrylate-co-acrylic acid) (95 percent) and cyan pigment (5 percent by weight of toner). The yield of dry toner particles was 98 percent. Morphology of the dry toner particles was investigated using Scan Electron Microscopy (SEM). SEM micrographs revealed particles with morphology resembling raspberries, where submicron resin particles partially flowed, and fused together, however, they were still distinguishable (See micrograph 1, FIG. 1).

EXAMPLE II

Pigment dispersion: 13 grams of dry pigment PV FAST BLUE TM and 5.85 grams of the cationic surfactant alkylbenzyldimethyl ammonium chloride (SANIZOL B-50 TM) were dispersed in 400 grams of water using an ultrasonic probe.

A polymeric latex was prepared by the emulsion polymerization of styrene/butylacrylate/acrylic acid (82/18/2 parts) in a nonionic/anionic surfactant solution (NEOGEN R TM /IGEPAL CA TM 897, 3 percent) as follows. 352 Grams of styrene, 48 grams of butylacrylate, 8 grams of acrylic acid, and 12 grams of dodecanethiol were mixed with 600 milliliters of deionized water in which 9 grams of sodium dodecyl benzene sulfonate anionic surfactant (NEOGEN R TM which contains 60 percent of active component), 8.6 grams of polyoxyethylene nonyl phenyl ether—nonionic surfactant (ANTAROX 897 TM −70 percent active), and 4 grams of ammonium persulfate initiator were dissolved. The emulsion was then polymerized at 70° C. for 8 hours. The resulting latex contained 40 percent of solids of poly(styrene-co-butylacrylate-co-acrylic acid, and 60 percent of water; the Tg of the latex dry sample was 53.1° C., as measured on DuPont DSC; $M_w$=20,000, and $M_n$=5,800 as determined on Hewlett Packard GPC. The zeta potential as measured on Pen Kem Inc. Laser Zee Meter was −80 millivolts. The particle size of the latex as measured on Brookhaven BI-90 Particle Nanosizer was 163 nanometers. The aforementioned latex was then selected for the toner preparation of Example II.

PREPARATION OF TONER SIZE PARTICLES:

Preparation of the aggregated particles: a dispersion of 13 grams of PV FAST TM pigment in 5.85 grams of SANIZOL B-50 TM and 400 grams of deionized water was added simultaneously with 650 grams of the above latex into a SD41 continuous stirring device containing 600 grams of deionized water. The anionic latex and dispersion of the pigment in the cationic surfactant were well mixed by continuous pumping through the high shear chamber operating at 10,000 rpm for 8 minutes. This blend was than transferred into a kettle placed in the heating mantle and equipped with temperature probe and mechanical stirrer, and it was aggregated at 35° C. for 3 days while stirring. The particle size of the aggregates was measured using the Coulter Counter as 4.7 microns (GSD=1.26).

Coalescence of aggregated particles—coalescence at 80° C. for 3 hours: after aggregation, the temperature in the kettle was raised from 35° C. to 80° C. and the contents of the kettle were stirred at this temperature for 3 hours. Coalesced toner particles were obtained. The toner particles were washed by filtration using hot water (50° C.) and dried on the freeze dryer. The resulting toner particles were comprised of poly(styrene-co-butylacrylate-co-acrylic acid) (95 percent) and cyan pigment (5 percent by weight of toner). The yield of dry toner particles was 98 percent. Morphology of the dry toner particles was investigated using Scan Electron Microscopy (SEM). SEM micrographs revealed particles with morphology resembling potatoes, where submicron resin particles flowed and fused together, which were not distinguishable (See micrograph 3, FIG. 3).

Figure 2:
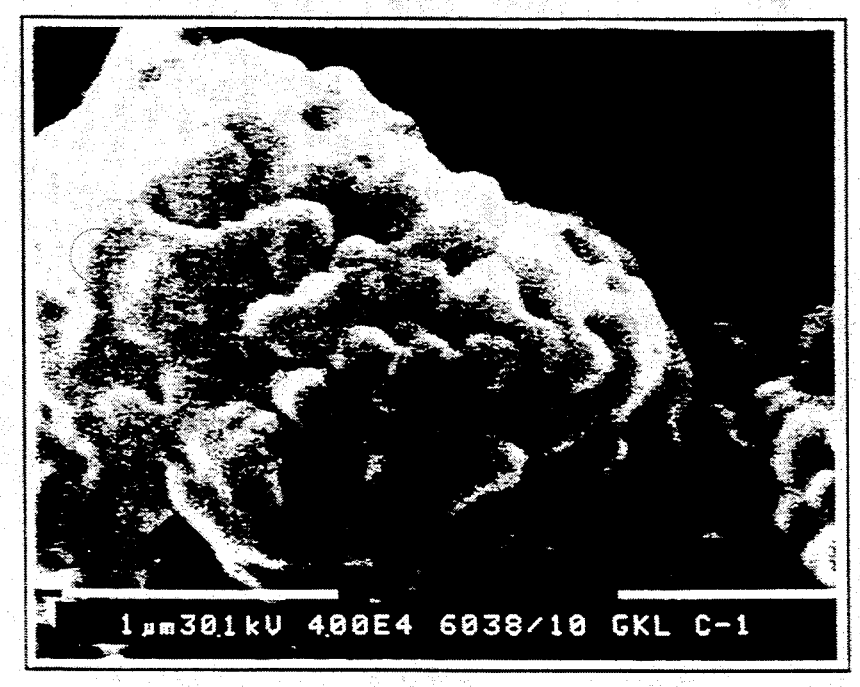

These morphologies achieved by performing the coalescence at two different temperatures of 65° C. (micrograph 2, FIG. 2) and 80° C. (micrograph 3, FIG. 3) were compared to each other, and they show the effect of the temperature of the coalescence (heating above the Tg of the resin) on the particle morphology. With an increase in temperature, the initially bumpy surface becomes smoother, and the morphology of the particles changes from the initially observed bunch of grapes (for aggregated particles which were not heated above the Tg—micrograph 1, FIG. 1), through the raspberries type of morphology (achieved by heating to 12 degrees above the resin Tg), to the potatoes type morphology (achieved by heating to 27 degrees above the resin Tg).

Comparison of Examples II and III illustrates the time of coalescence (heating above the resin Tg) as a factor controlling the morphology of the toner particles.

EXAMPLE III

Pigment dispersion: 13 grams of dry pigment PV FAST BLUE TM and 5.85 grams of cationic surfactant alkylbenzyldimethyl ammonium chloride (SANIZOL B-50 TM) were dispersed in 400 grams of water using an ultrasonic probe.

A polymeric latex was prepared by the emulsion polymerization of styrene/butylacrylate/acrylic acid (82/18/2 parts)in nonionic/anionic surfactant solution (NEOGEN R TM /IGEPAL CA 897 TM 3 percent) as follows. 352 Grams of styrene, 48 grams of butylacrylate, 8 grams of acrylic acid, and 12 grams of dodecanethiol were mixed with 600 milliliters of deionized water in which 9 grams of sodium dodecyl benzene sulfonate anionic surfactant (NEOGEN R TM which contains 60 percent of active component), 8.6 grams of polyoxyethylene nonyl phenyl ether—nonionic surfactant (ANTAROX 897 TM —70 percent active), and 4 grams of ammonium persulfate initiator were dissolved. The emulsion was then polymerized at 70° C. for 8 hours. The resulting latex contained 40 percent of solids; the Tg of the latex dry sample was 53.1° C., as measured on DuPont DSC; $M_w$=20,000, and $M_n$=5,800 as determined on Hewlett Packard GPC. The zeta potential as measured on Pen Kem Inc. Laser Zee Meter was −80 millivolts. The particle size of the latex as measured on Brookhaven BI-90 Particle Nanosizer was 163 nanometers. The aforementioned latex was then selected for the toner preparation of Example III.

PREPARATION OF TONER SIZE PARTICLES:

Preparation of the aggregated particles: a dispersion of 13 grams of PV FAST TM pigment in 5.85 grams of SANIZOL B-50 TM and 400 grams of deionized water was added simultaneously with 650 grams of the above latex into a SD41 continues stirring device containing 600 grams of deionized water. The anionic latex and dispersion of the pigment in the cationic surfactant were well mixed by continuous pumping through the high shear chamber operating at 10,000 rpm for 8 minutes. This blend was than transferred into a kettle placed in the heating mantle and equipped with a mechanical stirrer and temperature probe, and it was aggregated at 35° C. for 3 days. The particle size of the aggregates was measured using the Coulter Counter to be 4.7 microns (average volume diameter and a GSD of 1.26).

Coalescence of aggregated particles—Coalescence at 80° C. for 1 hour: after aggregation, the temperature in the kettle was raised from 35° C. to 80° C. and the contents of the kettle were stirred at this temperature for 1 hour. Coalesced toner particles were obtained. The toner particles were washed by filtration using hot water (50° C.) and dried on the freeze dryer. The resulting toner particles were comprised of poly(styrene-co-butylacrylate-co-acrylic acid) (95 percent) and cyan pigment (5 percent by weight of toner). The yield of dry toner particles was 98 percent. Morphology of the particles was investigated using Scan Electron Microscopy (SEM). SEM micrographs revealed particles with morphology resembling raspberries, where submicron resin particles partially flowed and fused together, and which particles were distinguishable (See micrograph 4, FIG. 4).

Figure 3:
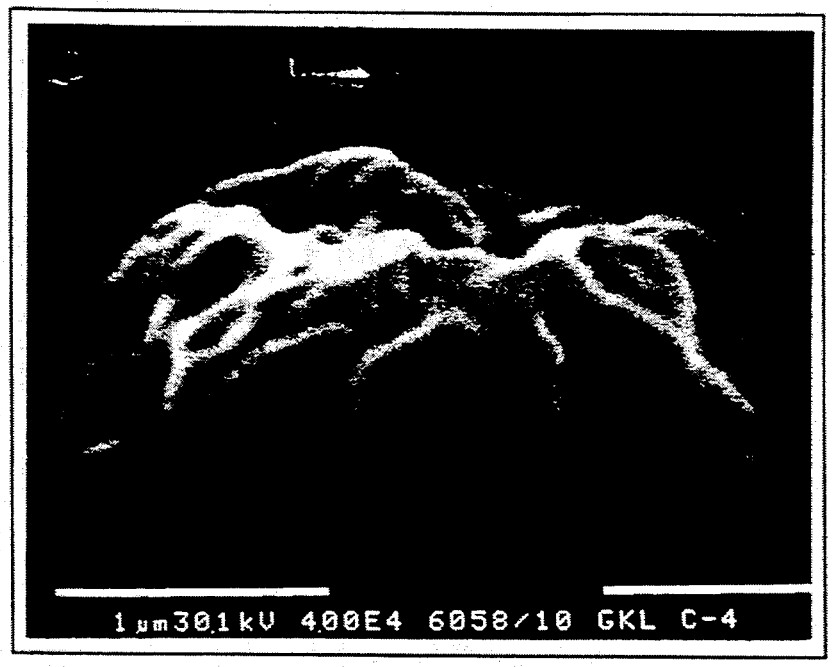
Figure 4:
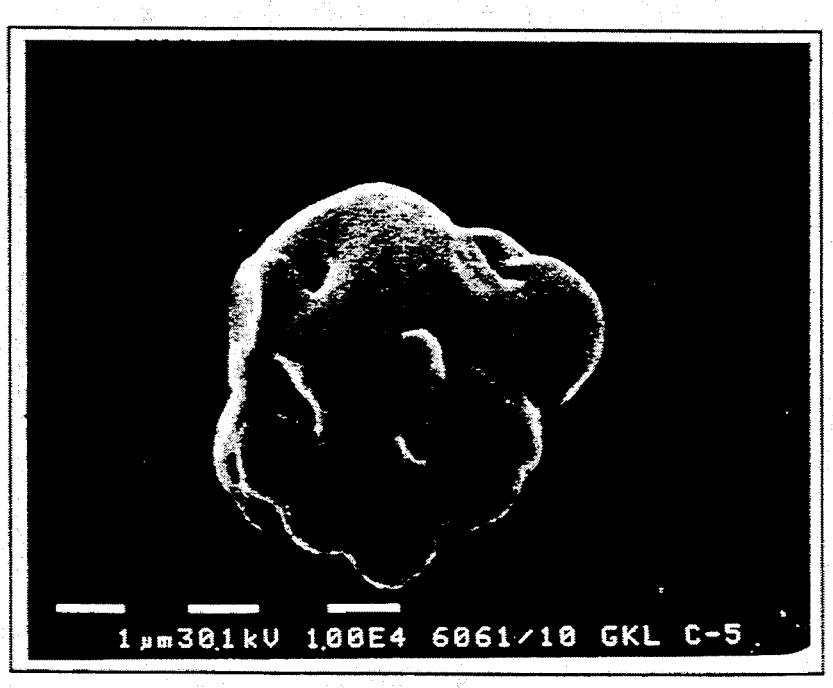

SEM micrographs 3 and 4, FIGS. 3 and 4, present the difference in the morphology of the particles achieved by performing the coalescence step at the same temperature, but for a different period of time, 1 hour vs 3 hours. These micrographs show that by increasing the time of coalescence one can change the morphology from the bumpy to the smooth surface.

Example IV illustrates the densely packed type of morphology that can be achieved, for example, when shearing (in the attritor) is applied in the aggregation step (iii) along with the aggregation at room temperature.

EXAMPLE IV

A polymeric latex was prepared by the emulsion polymerization of styrene/butadiene/acrylic acid (88/12/2 parts) in a nonionic/anionic surfactant solution (NEOGEN R TM /IGEPAL CA 897 TM, 3 percent) as follows. 176 Grams of styrene, 24 grams of butylacrylate, 4 grams of acrylic acid, and 5 grams of dodecanethiol were mixed with 300 milliliters of deionized water in which 4.5 grams of sodium dodecyl benzene sulfonate anionic surfactant (NEOGEN R TM which contains 60 percent of active component), 4.3 grams of polyoxyethylene nonyl phenyl ether—nonionic surfactant (ANTAROX 897 TM —70 percent active), and 2 grams of potassium persulfate initiator were dissolved. The emulsion was then polymerized in the pressurized reactor at 80° C. for 8 hours. The resulting latex contained 40 percent of solids; the Tg of the latex dry sample was 52.5° C., as measured on DuPont DSC; $M_w$=97,800, and $M_n$=7,800 as determined on Hewlett Packard GPC. The zeta potential as measured on Pen Kem Inc. Laser Zee Meter was −85 millivolts. The particle size of the latex as measured on Brookhaven BI-90 Particle Nanosizer was 167 nanometers. The aforementioned latex was then selected for the toner preparation of Example IV.

PREPARATION OF TONER SIZE PARTICLES:

Preparation of aggregated particles: 6 grams of HOSTAPERM PINK TM (wet cake) were placed in the attritor and 60 milliliters of water were added. The pigment was redispersed in water by attrition for 16 hours. At this point, 60 milliliters of the above latex were added and the blend was ball milled in the attritor for 24 hours. 1 Gram of ANTAROX TM was added at this stage and attrition was continued for 2 hours.

Figure 5:
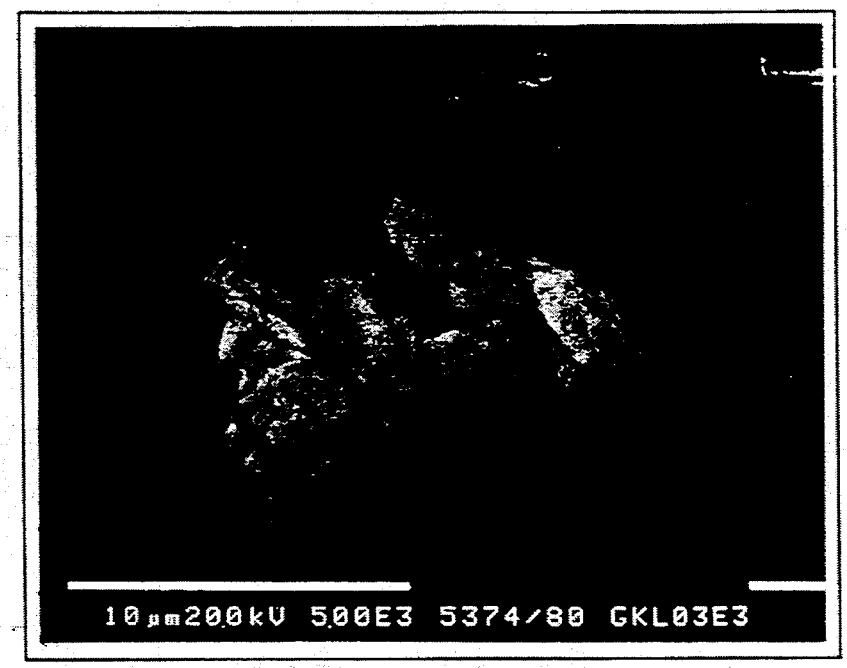

Preparation of coalesced toner particles: the above aggregated particles were than transferred into the kettle equipped with the mechanical stirrer and a temperature probe, diluted with water, and heated up to 70° C. for 2 hours. After cooling, particles were filtered on the Buchner funnel, washed with hot water several times, and dried on a freeze dryer. The resulting toner particles were comprised of poly(styrene-co-butadiene-co-acrylic acid) (90 percent) and magenta pigment (10 percent by weight of toner). The yield of dry toner particles was 95 percent. Morphology of the particles was investigated using Scan Electron Microscopy (SEM). SEM micrographs revealed particles with a morphology resembling potatoes, where submicron resin particles are fused together, and are not distinguishable. The surface of the toner particles was very smooth (See micrograph 5, FIG. 5).

Example V illustrates the flakes type of morphology which can be achieved when shearing (in the attritor) is applied along with the heating below the resin Tg in the aggregation step (iii).

EXAMPLE V

A polymeric latex was prepared by the emulsion polymerization of styrene/butylacrylate/acrylic acid (88/12/8 parts) in a nonionic/anionic surfactant solution (NEOGEN R TM /IGEPAL CA 897 TM, 3 percent) as follows. 176 Grams of styrene, 24 grams of butylacrylate, 16 grams of acrylic acid, and 5 grams of dodecanethiol were mixed with 300 milliliters of deionized water in which 4.5 grams of sodium dodecyl benzene sulfonate anionic surfactant (NEOGEN R TM which contains 60 percent of active component), 4.3 grams of polyoxyethylene nonyl phenyl ether—nonionic surfactant (ANTAROX 897 TM —70 percent active), and 2 grams of potassium persulfate initiator were dissolved. The emulsion was then polymerized at 80° C. for 8 hours. The resulting latex contained 40 percent of solids; the Tg of the latex dry sample was 65° C., as measured on DuPont DSC; $M_w$=110,000, and $M_n$=6,000 as determined on Hewlett Packard GPC. The zeta potential as measured on Pen Kem Inc. Laser Zee Meter was −90 millivolts. The particle size of the latex as measured on Brookhaven BI-90 Particle Nanosizer was 151 nanometers. The aforementioned latex was then selected for the toner preparation of Example V.

PREPARATION OF TONER PARTICLES:

Preparation of aggregated particles: 6 grams of HOSTAPERM PINK TM (wet cake) were placed in the attritor, and 60 milliliters of water were added. The pigment was redispersed in water by attrition for 64 hours. At this point, 60 milliliters of the above latex were added and the blend was ball milled in the attritor for 24 hours. At this point, 1 gram of ANTAROX TM was added, the temperature in the attritor was raised to 50° C., and the attrition was continued for 12 hours.

Figure 6:
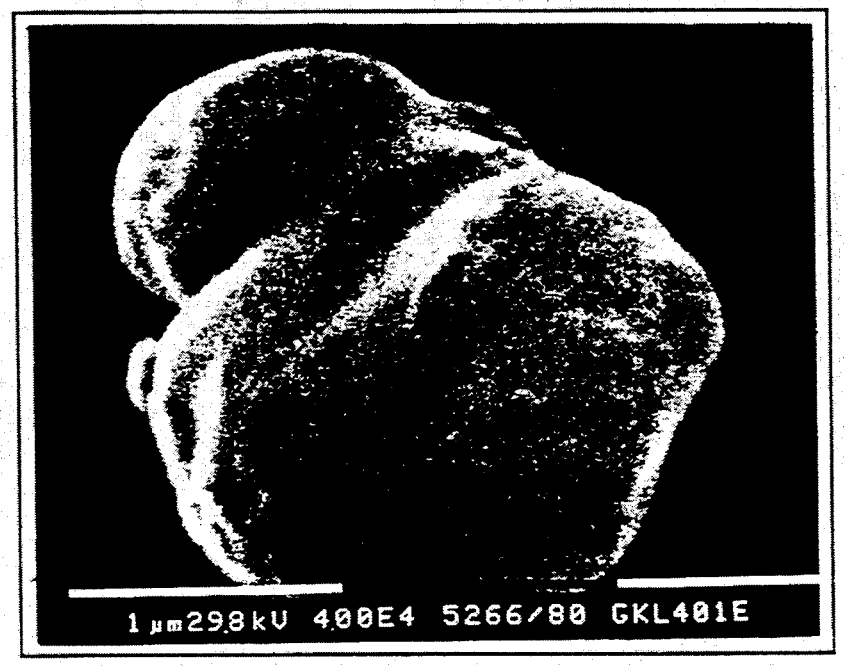

Preparation of coalesced toner particles: The above aggregated particles were than heated up to 70° C. for 2 hours. After cooling, particles were filtered on the Buchner funnel, washed with hot water several times, and dried on the freeze dryer. The resulting toner particles were comprised of poly(styrene-co-butadiene-co-acrylic acid) (90 percent) and magenta pigment (10 percent by weight of toner). The yield of dry toner particles was 95 percent. Morphology of the particles was investigated using Scan Electron Microscopy (SEM). SEM micrographs revealed particles with morphology resembling flakes (See micrograph 6, FIG. 6).

Example VI illustrates an almost spherical type of morphology of toner particles which is due to the excellent melt flow properties of the aggregated resin (polyester).

EXAMPLE VI

Preparation of polyester toner fines dispersion: toner fines of a size of 2 to 3 microns of copoly[4,4-isopropylidene bisphenol, ethylene oxide, 1,4-cyclo-hexanedimethanol terephthalic acid], 95 percent, polyester resin and 5 percent of magenta pigment were utilized as toner resin. 24 Grams of those fines were dispersed in 140 milliliters of water containing 0.55 gram of NEOGEN R TM and 0.57 gram of ANTAROX CA 897 TM by sonication, while stirring on a magnetic stirrer for 5 minutes.

Figure 7:
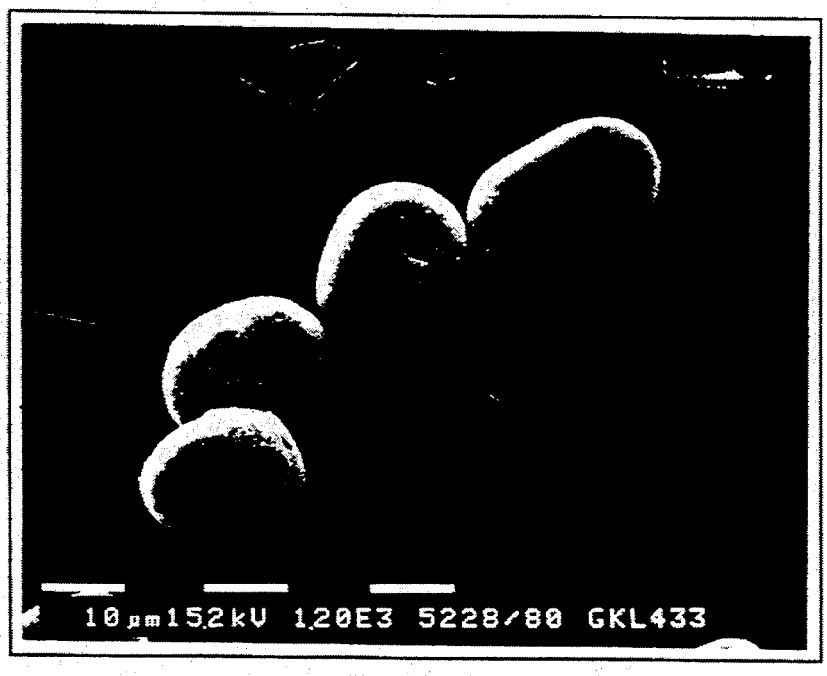

Preparation of toner particles: this dispersion was then homogenized for 2 minutes at 10,000 rpm, while 1 gram of cationic surfactant SANIZOL B-50 TM dissolved in 60 milliliters of deionized water was added. The dispersion was than polytroned for 2 minutes. The slurry was transferred into a kettle placed in the oil bath at 40° C. and stirred overnight, 18 hours. It was then heated up to 80° C. for 1 hour. Particles were filtered, washed with hot water seven times, and dried on a freeze dryer. SEM of the sample revealed an almost spherical shape of coalesced toner particles with a very smooth surface (See micrograph 7, FIG. 7).

EXAMPLE VII

Pigment dispersion: 2.4 grams of FANAL PINK TM dry pigment were dispersed in 60 milliliters of deionized water containing 0.5 gram of cationic surfactant alkylbenzyl dimethyl ammonium chloride (SANIZOL B-50 TM) by sonication using an ultrasonic probe, while cooling in a water/ice bath.

A polymeric latex was prepared by the emulsion polymerization of styrene/butylacrylate/acrylic acid (88/12/2 parts) in nonionic/anionic surfactant solution (NEOGEN R TM /IGEPAL CA 897 TM, 3 percent) as follows. 352 Grams of styrene, 48 grams of butylacrylate, 8 grams of acrylic acid, and 12 grams of dodecanethiol were mixed with 600 milliliters of deionized water in which 9 grams of sodium dodecyl benzene sulfonate anionic surfactant (NEOGEN R TM which contains 60 percent of active component), 8.6 grams of polyoxyethylene nonyl phenyl ether—nonionic surfactant (ANTAROX 897 TM —70 percent active), and 4 grams of ammonium persulfate initiator were dissolved. The emulsion was then polymerized at 70° C. for 8 hours. The resulting latex contained 40 percent of solids; the Tg of the latex dry sample was 73° C., as measured on DuPont DSC; $M_w$=37,000, and $M_n$=500 as determined on Hewlett Packard GPC. The zeta potential as measured on Pen Kem Inc. Laser Zee Meter was −80 millivolts. The particle size of the latex as measured on Brookhaven BI-90 Particle Nanosizer was 163 nanometers. The aforementioned latex was then selected for the toner preparation of Example VII.

PREPARATION OF TONER SIZE PARTICLES:

Preparation of the aggregated particles: the above prepared pigment dispersion was polytroned using a Brinkmann homogenizer for 2 minutes at 10,000 rpm. The mixture was homogenized for an additional 2 minutes at 10,000 rpm, while 60 milliliters of latex were added very slowly. The high viscosity of the blend was reduced by adding 120 milliliters of water. The sample was aggregated at room temperature for 24 hours while stirring.

Figure 8:
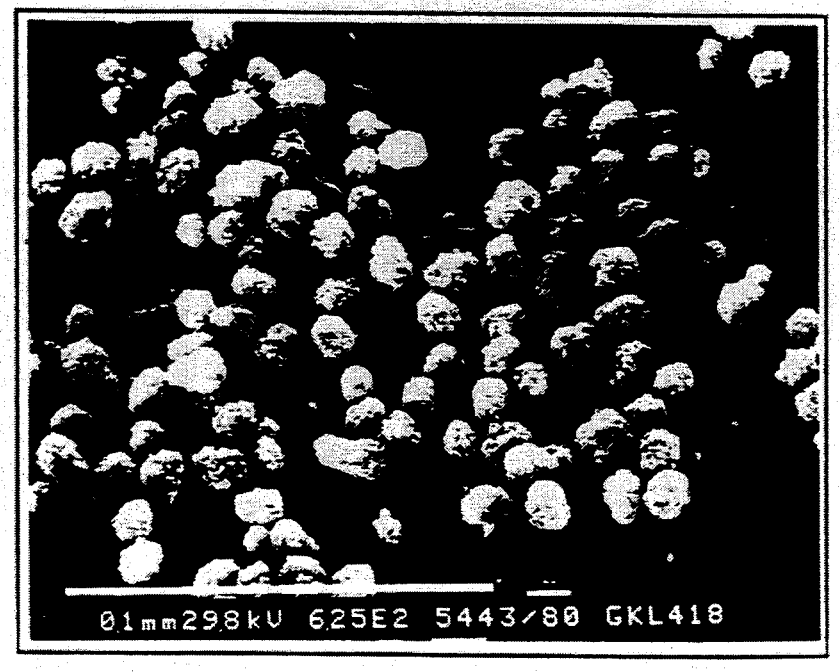

Coalescence of aggregated particles: after aggregation, the sample was heated to coalesce the particles for 2 hours at 80° C. The resulting toner particles were filtered, washed with hot water, and dried on a freeze dryer. The resulting toner particles were comprised of poly(styrene-co-butylacrylate-co-acrylic acid) (90 percent) and magenta pigment (10 percent by weight of toner). Morphology of the particles was investigated using Scan Electron Microscopy (SEM). SEM micrographs revealed particles with a morphology resembling raspberries, where submicron resin particles only partially flowed and fused together. The toner particles were distinguishable (See micrograph 8, FIG. 8).

EXAMPLE VIII

A pigment dispersion: 2.4 grams of FANAL PINK TM dry pigment were dispersed in 60 milliliters of deionized water containing 0.5 gram of cationic surfactant alkylbenzyl dimethyl ammonium chloride (SANIZOL B-50 TM) by sonication using an ultrasonic probe, while cooling in a water/ice bath.

A polymeric latex was prepared by the emulsion polymerization of styrene/butylacrylate (no acrylic acid) (88/12) in nonionic/anionic surfactant solution (NEOGEN R TM /IGEPAL CA 897 TM, 3 percent) as follows. 352 Grams of styrene, 48 grams of butylacrylate, and 12 grams of dodecanethiol were mixed with 600 milliliters of deionized water in which 9 grams of sodium dodecyl benzene sulfonate anionic surfactant (NEOGEN R TM which contains 60 percent of active component), 8.6 grams of polyoxyethylene nonyl phenyl ether—nonionic surfactant (ANTAROX 897 TM —70 percent active), and 4 grams of ammonium persulfate initiator were dissolved. The emulsion was then polymerized at 70° C. for 8 hours. The resulting latex contained 40 percent of solids of the above styrene butylacrylate; the Tg of the latex dry sample was 73° C., as measured on DuPont DSC; $M_w$=60,000, and $M_n$=1,100 as determined on Hewlett Packard GPC. The zeta potential as measured on Pen Kem Inc. Laser Zee Meter was −80 millivolts. The particle size of the latex as measured on Brookhaven BI-90 Particle Nanosizer was 167 nanometers. The aforementioned latex was then selected for the toner preparation of Example VIII.

PREPARATION OF TONER SIZE PARTICLES:

Preparation of the aggregated particles: the above pigment dispersion was polytroned using a Brinkmann homogenizer for 2 minutes at 10,000 rpm. The mixture was homogenized for an additional 2 minutes at 10,000 rpm, while 60 milliliters of the above latex were added. The sample was aggregated at room temperature for 48 hours while stirring.

Figure 9:
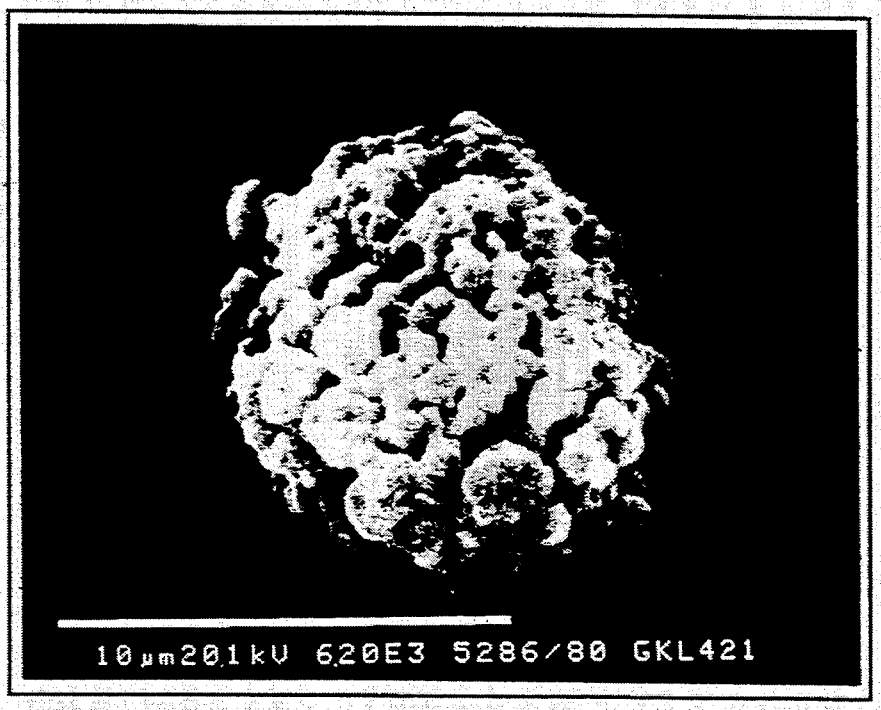

Coalescence of aggregated particles: after aggregation, the sample was heated to coalesce the particles for 2 hours at 80° C. The resulting toner particles were filtered, washed with hot water, and dried on the freeze dryer. The resulting toner particles comprised of poly(styrene-co-butylacrylate) (90 percent) and magenta pigment (10 percent by weight of toner). Morphology of the particles was investigated using Scan Electron Microscopy (SEM). SEM micrographs revealed particles with morphology resembling cauliflower (See micrograph 9, FIG. 9).

Solids refers to the components other than liquids like water, such as resin, pigment, charge additive, and the like. In embodiment, the grapes obtained can be modified to form raspberry, potato, or eventually spherical like particles as illustrated herein.

Other embodiments and modifications of the present invention may occur to those skilled in the art subsequent to a review of the information presented herein; these embodiments and modifications, as well as equivalents thereof, are also included within the scope of this invention.

What is claimed is:

1. A process for the preparation of toner compositions with controlled particle size and selected morphology consisting essentially of (i) preparing a pigment dispersion in water, which dispersion is comprised of pigment, ionic surfactant, and optionally a charge control agent;

(ii) shearing the pigment dispersion with a polymeric latex comprised of resin of submicron size, a counterionic surfactant with a charge polarity of opposite sign to that of said ionic surfactant and a nonionic surfactant thereby causing the formation of a uniform blend dispersion of resin particles, pigment particles, and optional charge control agent particles in water and surfactants, and wherein said resin particles, pigment particles, and optional charge control agent particles are flocculated or heterocoagulated together in said dispersion;

(iii) (a) continuously stirring and heating the above sheared blend to form electrostatically bound toner size aggregates; or (iii) (b) further shearing the above blend to form electrostatically bound well packed aggregates; or (iii) (c) continuously shearing the above blend, while heating to form aggregated flake particles;

(iv) heating the above formed aggregated particles above about the Tg of the resin to provide coalesced particles of toner; and optionally (v) separating said toner particles from water and surfactants; and (vi) drying said toner particles.

2. A process in accordance with claim 1 wherein the morphology of the toner particles is controlled to be from grape, cauliflower, raspberry, or potato up to substantially perfect spheres.

3. A process in accordance with claim 1 wherein the temperature above the resin Tg (step iv) primarily controls the morphology of the toner particles.

4. A process in accordance with claim 1 wherein the morphology of the toner particles is controlled by the shear rate in the range of from about 5,000 revolutions per minute to 15,000 revolutions per minute applied in the blending step (ii).

5. A process in accordance with claim 1 wherein the surfactant utilized in preparing the pigment dispersion is a cationic surfactant, and the counterionic surfactant present in the latex mixture is an anionic surfactant.

6. A process in accordance with claim 1 wherein the surfactant utilized in preparing the pigment dispersion is an anionic surfactant, and the counterionic surfactant present in the latex mixture is a cationic surfactant.

7. A process in accordance with claim 1 wherein the dispersion of pigment (i) is accomplished by homogenizing at from about 1,000 revolutions per minute to about 10,000 revolutions per minute at a temperature of from about 25° C. to about 35° C. for a duration of from about 1 minute to about 120 minutes.

8. A process in accordance with claim 1 wherein the dispersion of pigment (i) is accomplished by an ultrasonic probe at from about 300 watts to about 900 watts of energy, at from about 5 to about 50 megahertz of amplitude, at a temperature of from about 25° C. to about 55° C., and for a duration of from about 1 minute to about 120 minutes.

9. A process in accordance with claim 1 wherein the dispersion of pigment (i) is accomplished by microfluidization in a microfluidizer, or in nanojet for a duration of from about 1 minute to about 120 minutes.

10. A process in accordance with claim 1 wherein generating a uniform blend dispersion of resin particles, pigment particles, and optional charge control agent particles (ii) is accomplished by homogenizing at from about 1,000 revolutions per minute to about 10,000 revolutions per minute for a duration of from about 1 minute to about 120 minutes with a polytron or homogenizer.

11. A process in accordance with claim 1 wherein the heating of the blend of latex, pigment particles, surfactants and optional charge control agent particles in (iii a and c) is accomplished at temperatures of from about 20° C. to about 5° C. below the Tg of the resin for a duration of from about 0.5 hour to about 48 hours.

12. A process in accordance with claim 1 wherein the heating of the statically bound aggregate particles to form toner composition particles comprised of pigment particles, resin particles and optional charge control agent particles is accomplished at a temperature of from about 10° C. above the Tg of the resin to about 95° C. above Tg for a duration of from about 1 hour to about 8 hours, and wherein the resin of (ii) is of a submicron size of from about 0.05 to about 1 micron.

13. A process in accordance with claim 1 wherein the resin is selected from the group consisting of poly(styrene-butadiene), poly(paramethyl styrene-butadiene), poly(meta-methyl styrene-butadiene), poly(alpha-methylstyrene-butadiene), poly(methylmethacrylate-butadiene), poly(ethylmethacrylate-butadiene), poly(propylmethacrylate-butadiene), poly(butylmethacrylate-butadiene), poly(methylacrylate-butadiene), poly(ethylacrylate-butadiene), poly(propylacrylate-butadiene), poly(butylacrylate-butadiene), poly(styrene-isoprene), poly(paramethylstyrene-isoprene), poly(metamethylstyrene-isoprene), poly(alpha-methylstyrene-isoprene), poly(methylmethacrylate-isoprene), poly(ethylmethacrylate-isoprene), poly(propylmethacrylate-isoprene), poly(butylmethacrylate-isoprene), poly(methylacrylate-isoprene), poly(ethylacrylate-isoprene), poly(propylacrylate-isoprene), and poly(butylacrylate-isoprene).

14. A process in accordance with claim 1 wherein the resin is selected from the group consisting of poly(styrene-butadiene-acrylic acid) poly(styrene-butadiene-methacrylic acid) poly(styrene-butylmethacrylate-acrylic acid), or poly(styrene-butylacrylate-acrylic acid), polyethylene-terephthalate, polypropylene-terephthalate, polybutylene-terephthalate, polypentylene-terephthalate, polyhexalene-terephthalate, polyheptadene-terephthalate, and polyoctalene-terephthalate.

15. A process in accordance with claim 1 wherein the nonionic surfactant is selected from the group consisting of polyoxyethylene cetyl ether, polyoxyethylene lauryl ether, polyoxyethylene octyl ether, polyoxyethylene octylphenyl ether, polyoxyethylene oleyl ether, polyoxyethylene sorbitan monolaurate, polyoxyethylene stearyl ether, polyoxyethylene nonylphenyl ether, dialkylphenoxy poly(ethyleneoxy) ethanol, polyvinyl alcohol, methalose, methyl cellulose, ethyl cellulose, propyl cellulose, hydroxy ethyl cellulose, and carboxy methyl cellulose.

16. A process in accordance with claim 1 wherein the ionic surfactant is selected from the group consisting of sodium dodecyl sulfate, sodium dodecylbenzene sulfate, sodium dodecylnaphthalene sulfate, sodium lauryl sulfate, sodium alkyl naphthalene sulfonate, and potassium alkyl sulfonate.

17. A process in accordance with claim 1 wherein the pigment is carbon black, cyan, yellow, magenta, red, blue, green, brown, or mixtures thereof.

18. A process in accordance with claim 1 wherein the pigment is present in the amount of from about 0.1 to about 10 percent by weight.

19. A process in accordance with claim 1 wherein the pigment particles are from about 0.01 to about 1 micron in volume average diameter; the resin utilized in (ii) is from about 0.01 to about 3 microns in average volume diameter; the coalesced particles formed in (iv) are from about 1 to about 20 microns in average volume diameter; the toner composition isolated is from about 1 to about 20 microns in average volume diameter; and the geometric size distribution thereof of said toner composition is from about 1.15 to about 1.35.

20. A process in accordance with claim 1 wherein the toner particles are washed with warm water, and the surfactants are removed from the toner surface, followed by drying.

21. A process in accordance with claim 1 wherein there is added to the surface of the obtained toner particles additives of metal salts, metal salts of fatty acids, silicas, metal oxides, or mixtures thereof in an amount of from about 0.1 to about 10 weight percent of the obtained toner particles.

22. A process in accordance with claim 1 wherein the morphology of the toner particles is controlled by the shear time in the range of from about 5 minutes to about 2 hours applied in the blending step (ii).

23. A process for the preparation of toner comprising
(i) preparing a pigment dispersion, which dispersion is comprised of pigment and an ionic surfactant;
(ii) shearing the pigment dispersion with a polymeric latex comprised of resin with a size of from about 0.05 to about 1 micron in average volume diameter, a counterionic surfactant with a charge polarity of opposite sign to that of said ionic surfactant, and a nonionic surfactant thereby causing the formation of a uniform dispersion of pigment particles and resin in said surfactants, and wherein pigment particles and resin contained in said dispersion and wherein said pigment particles and resin are flocculated or heterocoagulated together in said dispersion;
(iii) (a) stirring and heating the uniform dispersion of pigment particles and resin particles (ii) to form electrostatically bound toner size aggregates; or
(iii) (b) shearing the above uniform dispersion of pigment particles and resin particles (ii) further from 2 to about 24 hours to form electrostatically bound densely packed aggregates; or
(iii) (c) shearing the above uniform dispersion of pigment particles and resin particles (ii), while heating, to form electrostatically bound toner size aggregates in the form of flakes; and
(iv) heating the statically bound aggregated particles above about the glass transition temperature of the resin to provide coalesced particles of toner.

24. A process in accordance with claim 23 wherein the glass transition temperature of resin is in the range of about 50° C. to about 80° C., and heating is accomplished for a period of from about 30 minutes to about 10 hours.

25. A process in accordance with claim 23 wherein subsequent to (iv) the following is accomplished:
(v) separating said toner particles from water and surfactants by filtration; and
(vi) drying said toner particles.

26. A process in accordance with claim 23 wherein the formed toner particles have a volume average diameter of from about 1 to about 10 microns, and wherein the solids are comprised of resin and pigment in an amount of about 5 to about 25 percent, and which solids are contained in water and anionic/nonionic/cationic surfactants.

* * * * *